US006371064B2

(12) United States Patent
Hartke et al.

(10) Patent No.: US 6,371,064 B2
(45) Date of Patent: Apr. 16, 2002

(54) METHOD FOR CONTROLLING AN ELECTROMECHANICAL ACTUATING DRIVE FOR A GAS EXCHANGE VALVE OF AN INTERNAL COMBUSTION ENGINE

(75) Inventors: Andreas Hartke, München; Achim Koch, Tegernheim, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/867,252

(22) Filed: May 29, 2001

Related U.S. Application Data

(63) Continuation of application No. PCT/DE99/03731, filed on Nov. 24, 1999.

(30) Foreign Application Priority Data

Nov. 26, 1998 (DE) ..... 198 54 627

(51) Int. Cl.[7] ..... F01L 9/04; F02D 41/20

(52) U.S. Cl. ..... 123/90.11; 251/129.01; 251/129.16

(58) Field of Search ..... 123/90.11, 90.15; 251/129.01, 129.1, 129.15, 129.16

(56) References Cited

U.S. PATENT DOCUMENTS 5,720,242 A * 2/1998 Izuo ..... 123/90.11
6,073,596 A * 6/2000 Kemper ..... 123/90.11

FOREIGN PATENT DOCUMENTS

DE 29607963 U1 1/1997

* cited by examiner

*Primary Examiner*—Weilun Lo
(74) *Attorney, Agent, or Firm*—Herbert L. Lerner; Laurence A. Greenberg; Werner H. Stemer

(57) ABSTRACT

An estimated value is calculated for a disturbing force which occurs as a result of the gas forces acting on the gas exchange valve immediately prior to the opening of the latter. The time profile of the disturbing force resulting at the gas exchange valve after the commencement of opening is estimated from a response of a transfer member to a jump in the disturbing force from the estimated valve to a predetermined value. An actuating signal for the actuator drive is determined as a function of the time profile of the disturbing force.

10 Claims, 2 Drawing Sheets

METHOD FOR CONTROLLING AN ELECTROMECHANICAL ACTUATING DRIVE FOR A GAS EXCHANGE VALVE OF AN INTERNAL COMBUSTION ENGINE

CROSS-REFERENCE TO RELATED APPLICATION

This application is a continuation of copending International Application No. PCT/DE99/03731, filed Nov. 24, 1999, which designated the United States.

BACKGROUND OF THE INVENTION

Field of the Invention

The invention lies in the automotive technology and engineering fields. More specifically, the invention relates to a method of controlling an electromechanical actuating drive for a gas exchange valve of an internal combustion engine.

A prior art internal combustion engine (see German utility model DE 296 07 963 U1) has at least one gas inlet valve and at least one gas outlet valve for each cylinder. The valves are driven by an electromechanical actuating drive. Particularly the gas outlet valve must open counter to a high cylinder internal pressure as a function of the current load state of the internal combustion engine. For this purpose, therefore, high opening forces must be applied as a function of the current load state. In the known internal combustion engine, the gas outlet valves are each provided on their side facing away from the cylinder interior, at a distance from the valve head, with a piston disk which is guided in a pressure compensating space. The pressure compensating space is capable of being connected to the cylinder interior via a pressure compensating duct. The piston disk can thus be acted upon in the opening direction of the gas outlet valve by the cylinder internal pressure. The disturbing forces occurring as a result of the cylinder internal pressure and acting on the gas outlet valve are therefore largely eliminated. In the prior art internal combustion engine, complicated bores have to be provided in the engine block and the cylinder head, and the gas inlet and gas outlet valves are designed differently, with the result that they can be produced in each case only in small quantities.

SUMMARY OF THE INVENTION

The object of the present invention is to provide a method for controlling an electromechanical actuating drive for a gas exchange valve of an internal combustion engine which overcomes the above-noted deficiencies and disadvantages of the prior art devices and methods of this general kind, and which is simple and which ensures that the electromechanical actuating drive operates reliably.

With the above and other objects in view there is provided, in accordance with the invention, a method for controlling an electromechanical actuating drive for a gas exchange valve of an internal combustion engine, which comprises:

calculating an estimated value for a disturbing force resulting from gas forces acting on a gas exchange valve immediately prior to opening the gas exchange valve;

estimating a time profile of the disturbing force resulting at the gas exchange valve after a commencement of opening from a response of a transfer member modeling the time profile of the disturbing force, to a jump in the disturbing force from the estimated value to a predetermined value, wherein an output variable of the transfer member represents the disturbing force; and determining an actuating signal for the actuating drive as a function of the time profile of the disturbing force; and controlling the electromechanical actuating drive with the actuating signal.

In accordance with an additional feature of the invention, the gas exchange valve is an outlet valve.

In accordance with an added feature of the invention, the estimated value of the disturbing force is calculated as a function of a variable characterizing the commencement of opening of the outlet valve and of a variable characterizing an air mass prior to combustion in a cylinder of the internal combustion engine.

In accordance with another feature of the invention, the estimated value of the disturbing force is calculated as a function of a fuel/air ratio.

It is also possible, according to a further feature of the invention, to calculate the estimated value of the disturbing force as a function of an ignition angle.

In accordance with yet a further feature of the invention, the estimated value of the disturbing force is calculated as a function of a variable characterizing an exhaust-gas pressure in an exhaust-gas tract of the internal combustion engine prior to the commencement of the opening of the outlet valve.

In accordance with again an added feature of the invention, at least one parameter of the actuating member is determined as a function of at least one operating variable of the internal combustion engine. Such exemplary operating variables include the rotational speed and/or a variable characterizing the commencement of the opening of the outlet valve.

In accordance with a concomitant feature of the invention, the above-noted transfer member is a PT1 member.

The invention is distinguished in that the electromechanical actuating drive can be operated with a low power loss and yet reliable operation of the actuating drive is ensured, irrespective of the disturbing force which acts on the gas exchange valve and which occurs as a result of the gas forces acting on the latter. The profile of the disturbing force is estimated accurately with a very high time resolution. It is therefore necessary to have only a small actuating reserve of the actuating forces which must be applied by the electromechanical actuating drive.

Other features which are considered as characteristic for the invention are set forth in the appended claims.

Although the invention is illustrated and described herein as embodied in a method for controlling an electromechanical actuating drive for a gas exchange valve of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
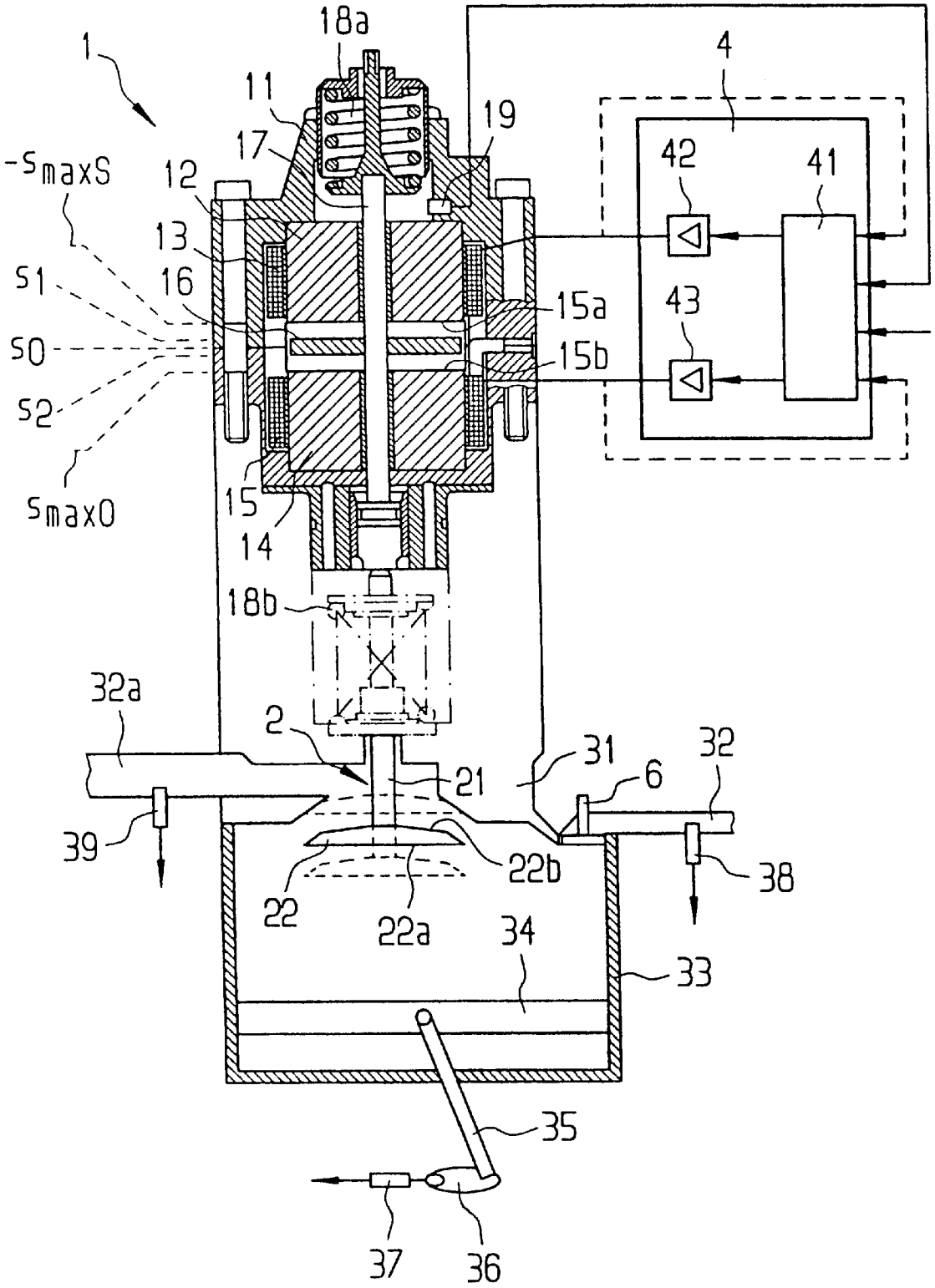
FIG. 1 is a partly sectional, partly schematic view of an assembly of an actuating drive and of a control device in an internal combustion engine.

Referring now to the figures of the drawing in detail and first, particularly, to FIG. 1 thereof, the internal combustion engine comprises an actuating drive which acts on a gas exchange valve and which is arranged in a cylinder head 31 of the internal combustion engine. The gas exchange valve is configured either as an outlet valve 2 or as an inlet valve 6. The gas exchange valve has a stem 21 and a head 22. The actuating drive 1 has a housing 11, in which a first and a second electromagnet are arranged. The first electromagnet has a first core 12 which is provided with a first coil 13. The second electromagnet has a second core 14 which is provided with a second coil 15. An armature is provided, the armature plate of which is arranged in the housing 11 so as to be moveable between a first bearing face 15*a* of the first electromagnet and a second bearing face 15*b* of the second electromagnet. The armature plate 16 is thus moveable between a closing position $s_{maxs}$ and an open position $s_{maxo}$. The armature comprises, furthermore, an armature shank 17 which is guided through recesses of the first and the second core 12, 14 and which is capable of being coupled mechanically to the stem 21 of the outlet valve 2. A first restoring means 18*a* and a second restoring means 18*b*, which are preferably configured as springs, bias the armature plate 16 into the predetermined position of rest $s_0$. A position sensor 19 is preferably provided, which is arranged on or in the actuating drive 1 in such a way that it indirectly or directly detects the position of the armature plate 16 and of the armature shank 17.

The actuating drive 1 is rigidly connected to the cylinder head 31 of the internal combustion engine. An intake duct 32, an exhaust duct 32*a* and a cylinder 33 with a piston 34 are provided in the internal combustion engine. The piston 34 is coupled to a crankshaft 36 via a connecting rod 35.

A control device 4 is provided, which detects the signals from sensors which include, for example, the position sensor 19 and/or a rotational-speed transmitter 37 and/or a load detection sensor 38 (e.g., an air-mass meter or a pressure sensor) and/or an exhaust-gas probe 39, which detects the fraction of exhaust gas in the exhaust duct 32*a* and determines an air/fuel ratio as a function of this, and/or a temperature sensor. The control device 4 communicates, if appropriate, with an overriding control device for engine operating functions and receives control signals from this. The control device 4 activates the first and the second coil 13, 15 of the actuating drive 1 as a function of the signals from the sensors and of the control signals. The control device 4 comprises a control unit 41, in which the actuating signals for the coils 13, 15 are calculated, and a first power output stage 42 and a second power output stage 43 which amplify the actuating signals. The control device 4 may alternatively also form a structural unit with the overriding control device for engine operating functions.

The disturbing force which occurs as a result of the gas forces acting on the gas exchange valve is the difference between the force generated from the cylinder internal pressure and acting on the head 22 on its end face 22*a* and the force occurring as a result of the exhaust-gas pressure and acting on the rear side 22*b* of the head 22. After the opening of the outlet valve 2, the cylinder internal pressure falls with the out-flowing exhaust gas, while the exhaust-gas pressure initially rises. This results in the disturbing force having high dynamics after the opening of the outlet valve. Tests on an engine test stand yield the surprising result that the time profile $F_{G,AV,t}$ of the disturbing force which results at the gas exchange valve after the commencement of opening can be estimated very accurately by the jump response of a transfer member to a jump in the disturbing force from the value of the disturbing force immediately prior to the opening of the gas exchange valve to a predetermined value which is preferably approximately zero.

Figure 2:
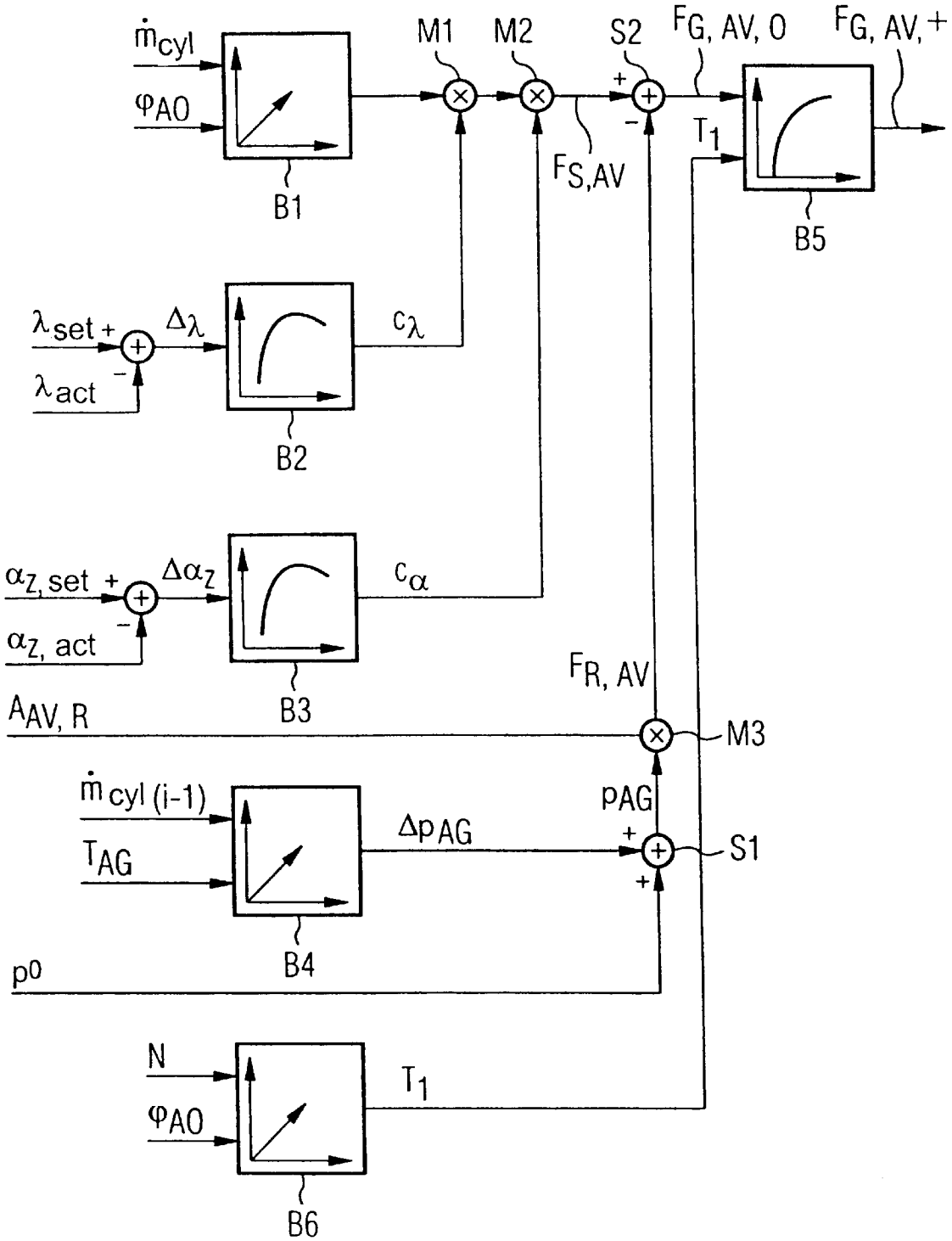
FIG. 2 is a schematic block diagram of the system for controlling the electromechanical actuating drive.

Referring now to FIG. 2, there is shown a block diagram for controlling the electromechanical actuating drive, the parts essential for the invention being illustrated. The block diagram is stored in the control device 4 preferably in the form of a program and is processed in the control unit 41 while the internal combustion engine is in operation.

In a block B1, a first contribution to an estimated value $F_{S,AV}$ of a force acting on the end face 22*a* of the valve head 22 is determined from a characteristic map as a function of a variable which characterizes the air mass prior to combustion in the cylinder 33 of the internal combustion engine, and which is preferably the mass air flow $\dot{m}_{cyl}$ into the cylinder 33, and of the opening angle $\phi_{AO}$ of the outlet valve 2, said opening angle relating to the crankshaft angle. In this case, the opening angle $\phi_{AO}$ is the crankshaft angle at which the armature plate 16 begins to move away from the closing position $s_{maxS}$ towards the open position $s_{maxO}$. In a block B2, a second contribution $c\lambda$ to the estimated value $F_{S,AV}$ of the force acting on the end face of the head 22 of the outlet valve 2 immediately prior to the opening of the outlet valve is determined from a characteristic map as a function of the difference $\Delta\lambda$ between a predetermined desired setpoint value $\lambda_{set}$ and an actual value $\lambda_{act}$ of the fuel/air ratio.

A third contribution $c_\alpha$ to the estimated value $F_{S,AV}$ of the force acting on the end face of the head 22 immediately prior to the opening of the outlet valve 2 is determined in a block B3 from a further characteristic map as a function of the difference $\Delta\alpha_z$ between a desired value $\alpha_{z,set}$ and an actual value $\alpha_{z,act}$ of the ignition angle. In the multiplication points M1 and M2, the first contribution, the second contribution $c\lambda$ and the third contribution $c_\alpha$ are linked by multiplication and thus yield the estimated value $F_{S,AV}$ of the force acting on the end face of the outlet valve immediately prior to the commencement of the opening of the outlet valve 2. The estimated value $F_{S,AV}$ of the force acting on the end face of the outlet valve immediately prior to the commencement of the opening of the latter is thus determined simply as a function of operating variables which are in any case available in a control device for engine operating functions.

An estimated value $p_{AG}$ of the exhaust-gas pressure is determined at a summing point S1 from the sum of the ambient pressure $P_0$ and a differential exhaust-gas pressure $\Delta p_{AG}$. The ambient pressure $P_0$ either is detected by an ambient-pressure sensor or is determined as a function of detected operating variables of the internal combustion engine in predetermined operating states of the internal combustion engine. The differential pressure $\Delta_{PAG}$ is determined in a block B4 from a characteristic map as a function of the mass air flow $\dot{m}_{cyl(i-1)}$, which was determined in the preceding cylinder segment, and an exhaust-gas temperature $t_{AG}$. A cylinder segment is defined by the crankshaft angle which is between the top dead centers of the pistons of two cylinders of the internal combustion engine which are adjacent in the ignition sequence. The mass air flow $\dot{m}_{cyl(i-1)}$ is the mass airflow which flowed into the respective cylinder in the preceding cylinder segment.

The exhaust-gas temperature $t_{AG}$ can either be detected by a temperature sensor arranged in the exhaust duct 32*a* or be determined as function of other operating variables of the internal combustion engine. Alternatively, a pressure sensor, which directly detects the exhaust-gas pressure $p_{AG}$, may also be arranged in the exhaust duct 32*a*.

At a multiplication point M3, the estimated value $F_{R,AV}$ of the force acting on the rear side of the head 22 immediately prior to the opening of the outlet valve 2 is calculated by the exhaust-gas pressure $p_{AG}$ being multiplied by the area $A_{AV,R}$ of the rear side 22*b* of the head 22.

At a summing point S2, the estimated value $F_{AG,AV,0}$ of the disturbing force acting on the gas exchange valve immediately prior to the opening of the latter is determined from the difference between the estimated values $F_{R,AV}$ and $F_{S,AV}$ and is fed to a block B5. The block B5 comprises a transfer member which models the time profile $F_{G,AV,t}$ of the disturbing force. The time profile $F_{G,AV,t}$ of the disturbing force after the commencement of the opening of the outlet valve 2 can be estimated with high accuracy from the jump response of a PT1 transfer member. For this purpose, the transfer member in the block B5 is acted upon by a jump in the disturbing force from the estimated value $F_{G,AV0}$ to a predetermined value, preferably about zero. The predetermined value is preferably selected such that it corresponds to the pressure gradient at the outlet valve 2 in the opened and quasi-stationary state of the flow at the outlet valve 2.

One of the parameters of the PT1 transfer member is the time constant $T_1$. It may either be permanently predetermined or, with the advantage of appreciably higher accuracy in the calculation of the profile $F_{G,AV,t}$ of the disturbing force, be determined in a block B6 from a characteristic map as a function of the rotational speed N and of the commencement of opening $\phi_{AO}$ of the outlet valve 2. The dynamics of the charge cycle operation is influenced appreciably by the time at which the outlet valve 2 is opened within the expansion or the expulsion stroke and by the speed of movement with which the piston assists the flow of exhaust gas over into the exhaust duct 32*a* or else counteracts this. This relation can simply be stored in a characteristic map as a function of the rotational speed N and of the commencement of opening $\phi_{AO}$ the outlet valve.

Even higher accuracy in the calculation of the time profile $F_{G,AV,t}$ of the disturbing force can be achieved if a more complex transfer member is modeled in the block B5 (for example PTn with n>1).

The calculation of the estimated value $F_{S,AV}$ of the force acting on the end face of the outlet valve immediately prior to the commencement of the opening of the latter and of the estimated value $F_{R,AV}$ of the force acting on the rear side of the outlet valve immediately prior to the commencement of the opening of the latter is carried out in the same cylinder segment, that is to say segment-synchronously, for which is also calculated the time profile ($F_{G,AV,t}$) of the disturbing force occurring, immediately prior to the opening of the gas exchange valve, as a result of the gas forces acting on the gas exchange valve. The time profile of the disturbing force can be determined in the block B5, for example, in a 100 $\mu$s grid and can consequently be used with high time resolution for calculating the actuating signals for the actuating drive.

Provided in the control unit 41 is an open loop controller or a closed-loop controller, the command variable of which is the current through the first or the second coil 13, 15 or the position of the armature plate 16. The controller generates an actuating signal which is corrected as a function of the profile of the disturbing force.

We claim:

1. A method for controlling an electromechanical actuating drive for a gas exchange valve of an internal combustion engine, which comprises:

calculating an estimated value for a disturbing force resulting from gas forces acting on a gas exchange valve immediately prior to opening the gas exchange valve;

estimating a time profile of the disturbing force resulting at the gas exchange valve after a commencement of opening from a response of a transfer member modeling the time profile of the disturbing force, to a jump in the disturbing force from the estimated value to a predetermined value, wherein an output variable of the transfer member represents the disturbing force; and determining an actuating signal for the actuating drive as a function of the time profile of the disturbing force; and controlling the electromechanical actuating drive with the actuating signal.

2. The method according to claim 1, wherein the gas exchange valve is an outlet valve.

3. The method according to claim 2, which comprises calculating the estimated value of the disturbing force as a function of a variable characterizing the commencement of opening of the outlet valve and of a variable characterizing an air mass prior to combustion in a cylinder of the internal combustion engine.

4. The method according to claim 2, which comprises calculating the estimated value of the disturbing force as a function of a fuel/air ratio.

5. The method according to claim 2, which comprises calculating the estimated value of the disturbing force as a function of an ignition angle.

6. The method according to claim 2, which comprises calculating the estimated value of the disturbing force as a function of a variable characterizing an exhaust-gas pressure in an exhaust-gas tract of the internal combustion engine prior to the commencement of the opening of the outlet valve.

7. The method according to claim 1, which comprises determining at least one parameter of the actuating member as a function of at least one operating variable of the internal combustion engine.

8. The method according to claim 7, wherein the operating variable is at least one variable selected from the group consisting of a rotational speed and a variable characterizing the commencement of the opening of the outlet valve.

9. The method according to claim 1, which comprises providing a PT1 member as the transfer member.

10. A method of generating an actuating signal for controlling an electromechanical actuating drive for a gas exchange valve of an internal combustion engine, which comprises:

calculating an estimated value for a disturbing force resulting from gas forces acting on a gas exchange valve immediately prior to opening the gas exchange valve;

estimating a time profile of the disturbing force resulting at the gas exchange valve after a commencement of opening from a response of a transfer member modeling the time profile of the disturbing force, to a jump in the disturbing force from the estimated value to a predetermined value, wherein an output variable of the transfer member represents the disturbing force; and determining an actuating signal for the actuating drive as a function of the time profile of the disturbing force.

* * * * *